US009883762B1

(12) United States Patent
Lampsa et al.

(10) Patent No.: US 9,883,762 B1
(45) Date of Patent: Feb. 6, 2018

(54) TREE SKATE

(71) Applicants: John B. Lampsa, Wales, WI (US); Ursula R. Lampsa, Wales, WI (US)

(72) Inventors: John B. Lampsa, Wales, WI (US); Ursula R. Lampsa, Wales, WI (US)

( * ) Notice: Subject to any disclaimer, the term of this patent is extended or adjusted under 35 U.S.C. 154(b) by 0 days.

(21) Appl. No.: 15/462,297

(22) Filed: Mar. 17, 2017

(51) Int. Cl.
*A47G 33/12* (2006.01)

(52) U.S. Cl.
CPC .... *A47G 33/126* (2013.01); *A47G 2033/1273* (2013.01)

(58) Field of Classification Search
CPC ..... A47G 33/12; A47G 33/126; A47G 2033/1273; B62B 15/007; A47B 91/06
USPC ..... 294/15, 172; 280/18.1, 19, 28.12; 248/519, 145.6; 16/42 R
See application file for complete search history.

(56) References Cited

U.S. PATENT DOCUMENTS 3,901,526 A * 8/1975 Scott ..... B62B 13/08 280/18.1
4,502,244 A 3/1985 Yoham
5,081,740 A * 1/1992 Smith ..... A47B 91/06 16/42 R
5,118,067 A 6/1992 Gillanders
5,323,558 A 6/1994 Baumler
5,388,799 A * 2/1995 Keefe ..... A47G 33/12 248/129
5,702,086 A * 12/1997 Hunt ..... A47G 33/12 248/519
D406,080 S 2/1999 Marr
5,987,813 A 11/1999 Lasko
D418,372 S 1/2000 Ning
6,145,795 A 11/2000 McAdam et al.
D465,999 S * 11/2002 Weixelman ..... D11/130.1
6,983,921 B1 1/2006 Rahmer
D536,227 S 2/2007 Loeser
8,671,613 B2 3/2014 Crilly et al.
8,814,121 B2 * 8/2014 Koberg ..... B66C 23/78 248/346.01
9,615,662 B1 * 4/2017 Amber ..... A47B 91/06
2004/0026594 A1 * 2/2004 Lee ..... A47G 33/12 248/523
2004/0262183 A1 12/2004 Gildart
2006/0255230 A1 11/2006 Bornemeier et al.
(Continued)

FOREIGN PATENT DOCUMENTS

CA 2166814 7/1997
WO WO 90/10409 9/1990

*Primary Examiner* — Dean J Kramer
(74) *Attorney, Agent, or Firm* — Ryan Kromholz & Manion, S.C.

(57) ABSTRACT

The present invention is a tray apparatus providing mobility of a Christmas tree in a tree stand. The invention comprises a pan for placing the tree stand and a releasably attached handle. The improved mobility provided by the smooth, low-friction pan and removable handle of the present invention assists in decoration of the tree by allowing rotation for placing lights and ornaments, or other decorating tasks, as well as to present a favored side toward a desired area of the room in which it is placed. The tree may also be decorated in any convenient location and then moved laterally into the desired final position. In addition to the relatively frictionless movement provided by the pan, it also provides a basin to contain any water that spills from the stand, to catch needles, to hold presents, and to protect the floor or carpet.

2 Claims, 4 Drawing Sheets

(56) References Cited

U.S. PATENT DOCUMENTS

| | | | | |
|---|---|---|---|---|
| 2007/0089360 | A1 | 4/2007 | Koch | |
| 2009/0039607 | A1* | 2/2009 | Feeney | B62B 15/00 280/18.1 |

* cited by examiner

TREE SKATE

BACKGROUND OF THE INVENTION

The present invention relates generally to a tray to be used with a tree stand, and more particularly to a tray for moving a tree stand that holds a Christmas tree, which accommodates movement and rotation of the stand and the tree by means of a pan with a smooth, low-friction bottom surface and a detachable handle to direct the movement of the apparatus and tree.

One of the most recognized traditions of the Christmas holiday is the Christmas tree. Families across the world put up Christmas trees in their homes, decorate them with lights and varieties of ornaments, and place their Christmas gifts underneath them. The Christmas tree is often the focal point of the Christmas decorations.

The Christmas trees are often placed in a supportive stand to brace the tree in an upright position. These stands often further provide a basin for holding water for the tree. Many stands serve only these and other limited purposes, and are not assistive in the decorating of the tree, or in transport of the tree into a desired position. In fact, depending on the form, weight, size, or material of the stand, its design might severely impede mobility.

It is known in the art of Christmas trees and tree stands to provide desired mobility by designing a tree stand utilizing wheels. However, most owners continue to use basic stands that do not comprise wheels, due to availability in stores, cost, familiarity with the presently-owned stand, or various other reasons that stands with wheels are not widely used. In addition, equipping the stand with wheels enables the stand to move with little effort, and could result in movement that was unintentional—which is of particular concern when homes are filled with many people and many activities are taking place around the tree, as during the holiday season.

Accordingly, there remains a need for an apparatus that promotes mobility of the tree that can be used in association with a presently owned, basic tree stand. In addition, there remains a need for a pan for a tree that is easily moveable, yet sufficiently stable to prevent unintentional shifting and movement. The present invention satisfies this need.

SUMMARY OF THE INVENTION

The present invention provides a tray apparatus for use under a tree stand, such as a Christmas tree stand, that is configured for efficient movement of the stand and the tree supported by the stand. In the preferred embodiment, the tray apparatus for the tree stand has a shallow, concave pan, similar in design and appearance to a common frying pan. The pan has a flat, smooth bottom surface which is in contact with the floor or ground. The pan is configured to hold the tree stand on the upper surface of the pan and within side walls. These side walls turn upwardly from the flat surface to contain the tree stand as well as any water that might spill from the tree stand reservoir or needles from the tree.

According to the preferred embodiment, the tray apparatus also has a handle to provide and control movement of the pan and tree. The handle accommodates sliding the tree between locations, and also rotating the tree during decoration. The handle is preferably releasably attached to the pan, so that it may be removed from the tray apparatus once the tree is in place.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
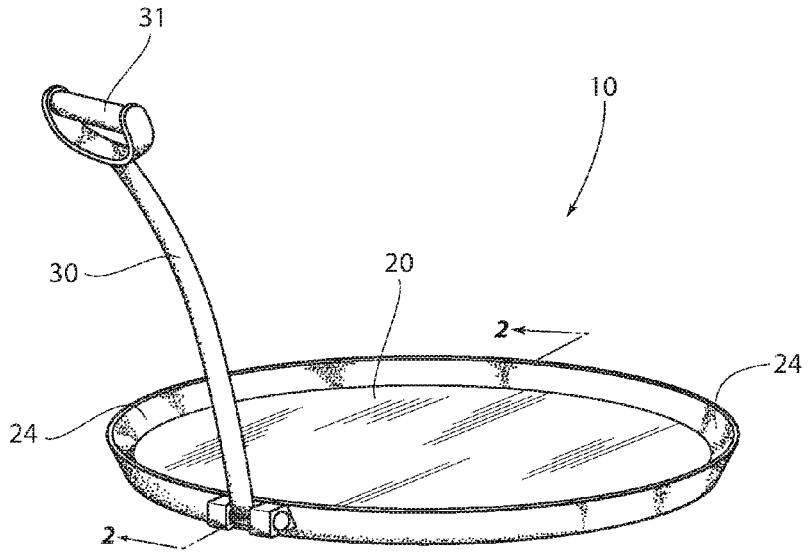
FIG. 1 illustrates a perspective view of a tray apparatus according to the present invention
Figure 2:
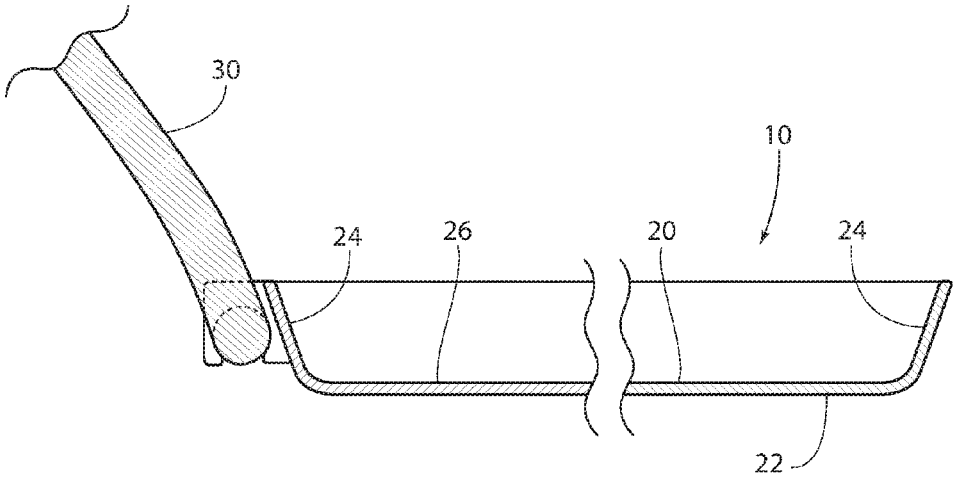
FIG. 2 illustrates a cross-sectional view of the pan of a tray apparatus according to the present invention

FIG. 1 is a perspective view of a tray apparatus 10 having a pan 20 to contain a tree stand and a handle 30 used to assist in movement of the apparatus, stand, and tree. In the preferred embodiment, the pan 20 is designed much like a common frying pan, having a diameter slightly larger than that of the average-sized tree stand, generally between three feet and four feet, although any sized pan capable of containing the tree stand is suitable for the present invention. The peripheral edges of the pan 20 are bowed up to form side walls 24. The walls 24 serve as retaining means that may retain water spilled from the tree stand, tree needles, or any other article that is desired to be kept off the floor or carpet on which the tree is placed. The pan 20 is shallow in depth, defined by the height of the side walls 24, as shown in the figures. The height of the side walls 24 is preferably at least one inch, although any wall height capable of retaining the tree stand, water, needles, etc may be appropriate for the present invention.

The pan 20 is preferably made of a material with two surfaces, at least one of the surfaces substantially lacking ribs, grooves, or other friction-creating elements. This smooth surface is configured as the bottom face 22 of the pan 10, which is smooth to lessen friction between the tray and the floor or carpet, thereby increasing ease of mobility. The tree stand is placed on an upper face 26 of the pan, within the area contained between the side walls 24.

Figure 9:
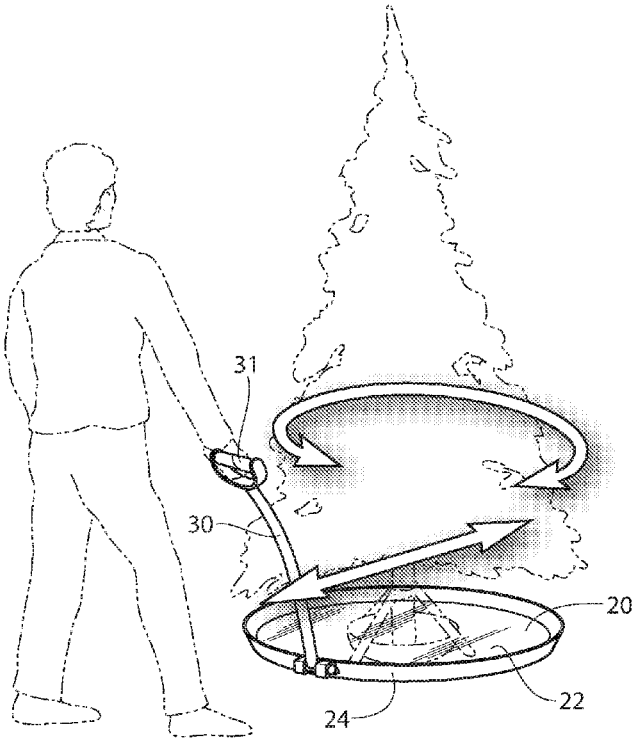
FIG. 9 illustrates a tray apparatus according to the present invention being used in association with a Christmas tree.

To further assist in the mobility of the pan 20, as well as the tree stand and tree, the present invention comprises a handle member 30 extending from the outer surface of the side wall 24 on the pan 20, as shown in FIG. 1. The handle 30 is useful during decorating the tree as a means of rotating the tree for placing lights or ornaments on the tree. It is also useful for moving the tree into a desired final placement in a room, as shown in FIG. 9. The handle 30 is preferably a rigid member with an accessory 31, at the end opposite of attachment to the pan 20, that is configured for grasping the handle member and using it to control movement of the tray 10. As shown in the figures, the accessory 31 may be a substantially d-shaped accessory with an aperture through which a user may grasp the handle, although any configuration allowing for grasping the handle member 30 may be used. The handle 30 is preferably releasably attached to the pan 20, thus able to be removed after the tree has been moved to its desired position.

Figure 3:
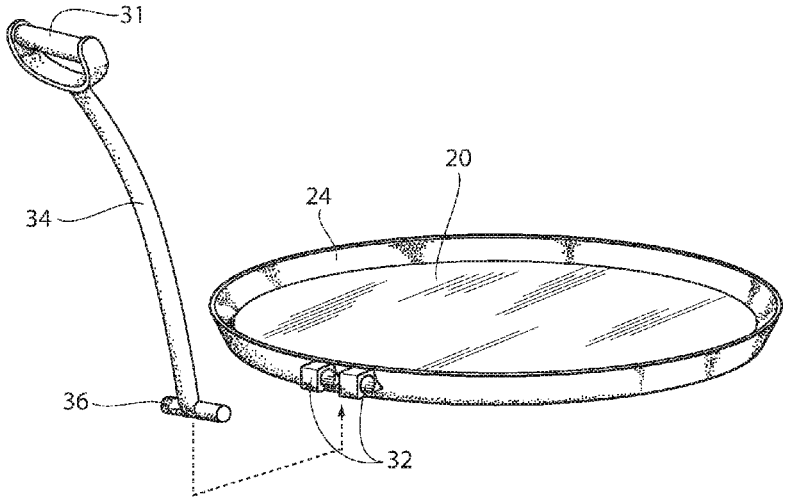
FIG. 3 illustrates a perspective view of a tray apparatus according to the present invention exhibiting one possible configuration of the releasably attached handle, particularly showing the cylindrical t-shaped end 36 and compatible hooks 32.
Figure 4:
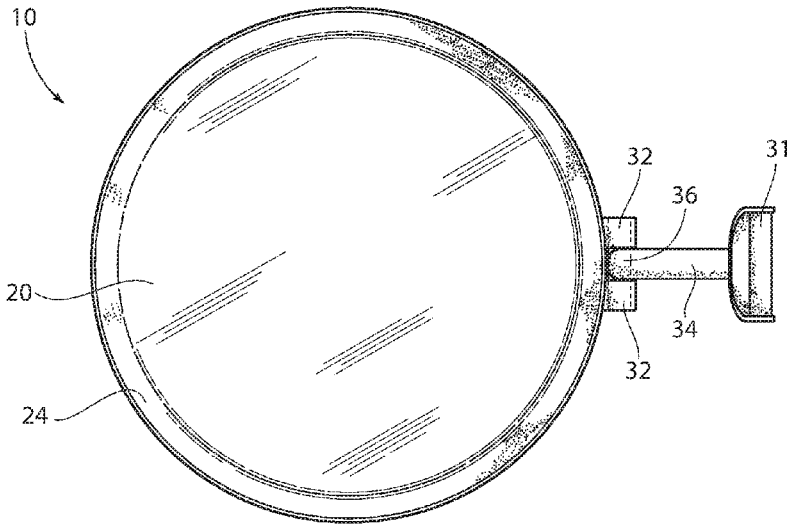
FIG. 4 illustrates a top view of one possible configuration of the releasably attached handle wherein the cylindrical t-shaped handle 36 and compatible hooks 32 are engaged

Various means of releasable attachment have been contemplated for the present invention. In one embodiment, shown in FIG. 3, a pair of circular hook-shaped devices 32, with gap positioned in a downward direction, are fixed to a portion of the side wall 24. The compatible handle 34 has a cylindrical t-shaped end 36. The handle is releasably attached to the pan by placing the t-shaped end 36 below the hook devices 32, pulling the handle 34 up, whereby snapping the t-shaped end 36 into engagement with the hook devices 32, as shown in FIG. 4.

Figure 5:
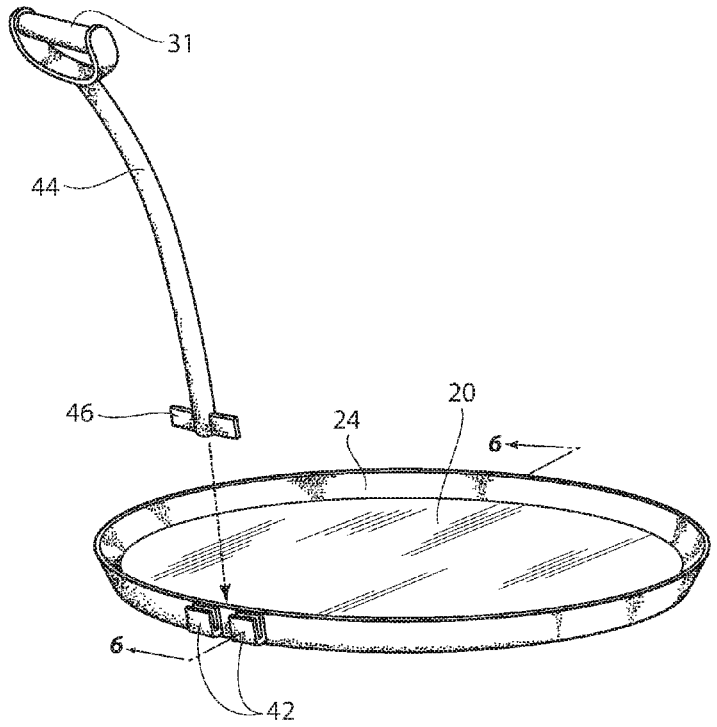
FIG. 5 illustrates a perspective view of a tray apparatus according to the present invention exhibiting a second possible configuration of the releasably attached handle, particularly showing the flat, t-shaped end 46 and the compatible substantially flat hook devices 42.
Figure 6:
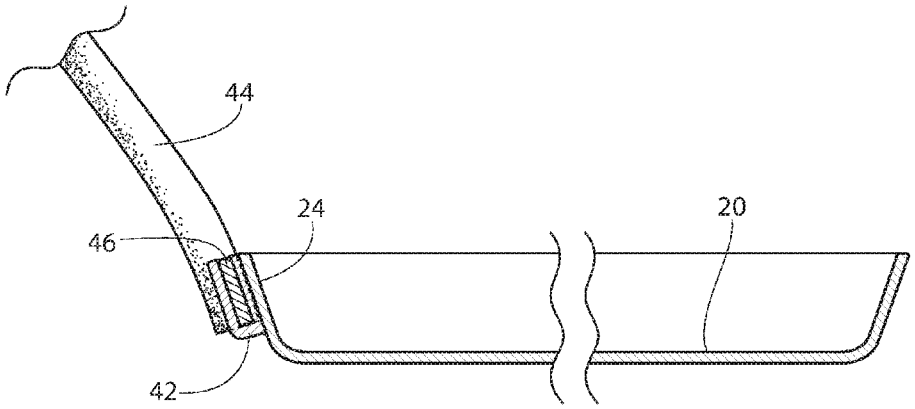
FIG. 6 illustrates a cross-sectional view of a second possible configuration of the releasably attached handle wherein the flat, t-shaped end 46 and compatible hooks 42 are engaged

In a second embodiment of the releasably attached handle, as shown in FIG. 5, a pair of substantially flat hook devices 42 are fixed to a portion of the side wall 24. The opening of the hook 42 is positioned in an upward direction. The compatible handle 44 has a flat, t-shaped end 46 which can be placed in a position above and relative to the opening of the hook 42 and moved in a downward direction to slide the flat t-shaped end 46 into place for engagement with the hook 42, as shown in FIG. 6.

Figure 7:
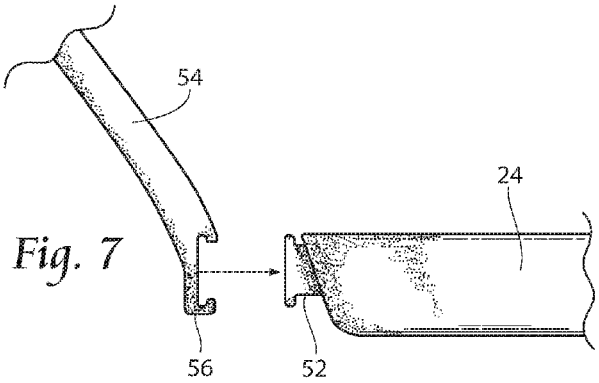
FIG. 7 illustrates a side view of a tray apparatus according to the present invention exhibiting a third possible configuration of the releasably attached handle, particularly showing a handle attachment piece 52 and a compatible end 56 on the handle.
Figure 8:
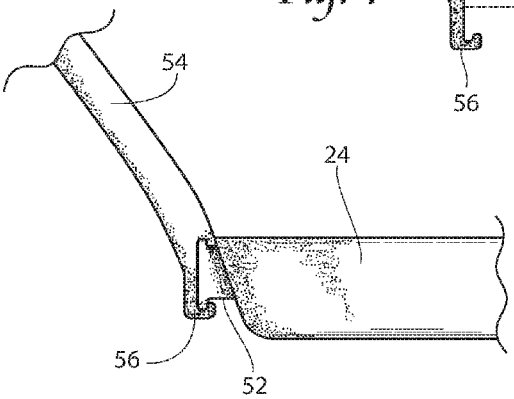
FIG. 8 illustrates a side view of a third possible configuration of the releasably attached handle wherein the handle attachment piece 52 compatible handle end 56 are engaged

In a third embodiment of the releasably attached handle, as shown in FIG. 7, the connecting end 56 of the handle 54 is configured for compatibility with a handle attachment 52 fixed to a portion of the side wall 24. The lower portion of the connecting end 56 is placed in position relative to the lower portion of the handle attachment piece 52. The handle 54 is then rotated up to snap the upper portions of the handle attachment piece 52 and connecting end 56 into engagement, as shown in FIG. 8.

Any means of releasable attachment may be used for this purpose, it is not limited to these disclosed embodiments.

A method for use of the tray apparatus 10 is also contemplated, comprising the steps of providing the apparatus 10 described above, placing a tree in a tree stand and the tree stand on the upper surface 22 of the pan 20 of the apparatus. Then, the tree may be rotated for decoration or placement, and/or may be moved laterally along the floor to a desired final position in a room or an area, as shown in FIG. 9. The method also comprises removing and attaching the rigid handle 30 by means of releasable attachment.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A tray apparatus configured to facilitate the mobility of a tree stand, said tree stand configured to support a tree, said apparatus comprising:

a pan having a diameter at least slightly larger than said tree stand, said pan having a bottom face having a substantially frictionless surface, an upper face for receiving said tree stand, and upwardly bowed peripheral edges creating a side wall having an inner face and outer face;

an elongated, rigid handle member;

a pair of circular hook devices positioned on at least a portion of said outer face of said side wall;

a cylindrical t-shaped end on said rigid handle member; and wherein said circular hook devices and said t-shaped end are configured for releasable engagement with one another.

2. A tray apparatus configured to facilitate the mobility of a tree stand, said tree stand configured to support a tree, said apparatus comprising:

a pan having a diameter at least slightly larger than said tree stand, said pan having a bottom face having a substantially frictionless surface, an upper face for receiving said tree stand, and upwardly bowed peripheral edges creating a side wall having an inner face and outer face;

an elongated, rigid handle member;

a pair of substantially flat hook devices positioned on at least a portion of said outer face of said side wall;

a flat, t-shaped end on said rigid handle member;

wherein said flat hook devices and said t-shaped end are configured for releasable engagement with one another.

* * * * *